United States Patent [19]

Gavronsky

[11] 4,450,037

[45] May 22, 1984

[54] ENVELOPE FLAP SEALING DEVICE

[75] Inventor: German Gavronsky, Stamford, Conn.

[73] Assignee: Pitney Bowes Inc., Stamford, Conn.

[21] Appl. No.: 506,913

[22] Filed: Jun. 22, 1983

[51] Int. Cl.[3] ..... B05C 1/02

[52] U.S. Cl. ..... 156/441.5; 118/32; 156/442; 156/442.2

[58] Field of Search ..... 156/441.5–442.3; 118/243, 264, 268, 32

[56] References Cited

U.S. PATENT DOCUMENTS

| | | | |
|---|---|---|---|
| 2,944,511 | 7/1960 | Bach | 118/268 X |
| 3,334,610 | 8/1967 | Faust | 118/32 |
| 3,353,513 | 11/1967 | Schmitt | 118/32 |

*Primary Examiner*—David A. Simmons

*Attorney, Agent, or Firm*—Lawrence E. Sklar; William D. Soltow, Jr.; Albert W. Scribner

[57] ABSTRACT

An envelope flap sealing device in a mailing machine, including a moistener separator blade, a moistening brush attached to and located downstream of the separator blade, at least one pair of feed rollers for transporting envelopes past the moistening brush, a pivotable, deflecting baffle situated intermediate the feed rollers and the separator blade, and a cam operatively connected to the deflecting baffle for pivoting the baffle about its downstream end whereby the upstream end of the baffle is translatable between a raised position and a flat position, wherein the raised position guides an envelope flap under the moistening brush to thereby seal the flap and the flat position causes the envelope flap to pass over the moistening brush and not be sealed.

6 Claims, 9 Drawing Figures

20
21
22
24
26
28
30
32
34
36
38
40
42
44
46
48
50
52
54
56
68
70

3
3

20
40
70
36
68
66
38
58
24
64
32
22

34
7
6
44
42
52
46
48
60
50
54
26

20
22
24
26
32
34
36
38
40
42
44
46
48
50
52
54
58
60
64
66
68
70

ENVELOPE FLAP SEALING DEVICE

BACKGROUND OF THE INVENTION

The instant invention relates to envelope sealing devices, and more particularly to envelope sealing devices for processing mail preparatory to admission thereof to a postage meter for imprinting of postage.

Mail to be imprinted in an automatic postage meter is generally stored in stack form. Single letters taken from such a stack are run through an envelope sealing device where the flaps thereof are moistened and sealed prior to the envelope being passed through the postage meter. In such an arrangement, difficulties tend to arise if the mail to be processed includes envelopes which should not be sealed, e.g. envelopes with printed matter as contrasted with letter mail.

Prior art sealing devices have provided a pivotable moistening pad which is normally in an operative position for moistening the flaps of an envelope in transit through the sealing device, but which may be pivoted out of the path of such envelopes whenever no moistening action is desired. Because of the pivotal support of the moistening pad in such devices their sealing action has not proven satisfactory when called upon to seal envelopes of various kinds.

Other prior art sealing devices are provided with a fixed envelope flap moistening surface and with baffle means shiftable to two limit positions for controlling the path of envelopes through the sealing device to cause the envelopes to engage and by-pass selectively the fixed envelope flap moistening surface. Such prior art baffle means have required the movement of two separate elements which are in engagement with the envelopes to provide proper engagement and by-pass paths. The instant invention provides the same engagement and by-pass paths, but does so with only a singular moving element engaging the envelopes.

SUMMARY OF THE INVENTION

The instant invention therefore provides an envelope flap sealing device in a mailing machine. The sealing device includes a moistener separator blade, a moistening brush attached to and located downstream of the separator blade, at least one pair of feed rollers for transporting envelopes past the moistening brush, a pivotable, deflecting baffle situated intermediate the feed rollers and the separator blade, and a cam operatively connected to the deflecting baffle for pivoting the baffle about its downstream end whereby the upstream end of the baffle is translatable between a raised position and a flat position, wherein the raised position guides an envelope flap under the moistening brush to thereby seal the flap and the flat position causes the envelope flap to pass over the moistening brush and not be sealed.

BRIEF DESCRIPTION OF THE DRAWINGS

FIG. 9 is an enlarged, perspective view of the deflector blade.

DETAILED DESCRIPTION

Figure 1:
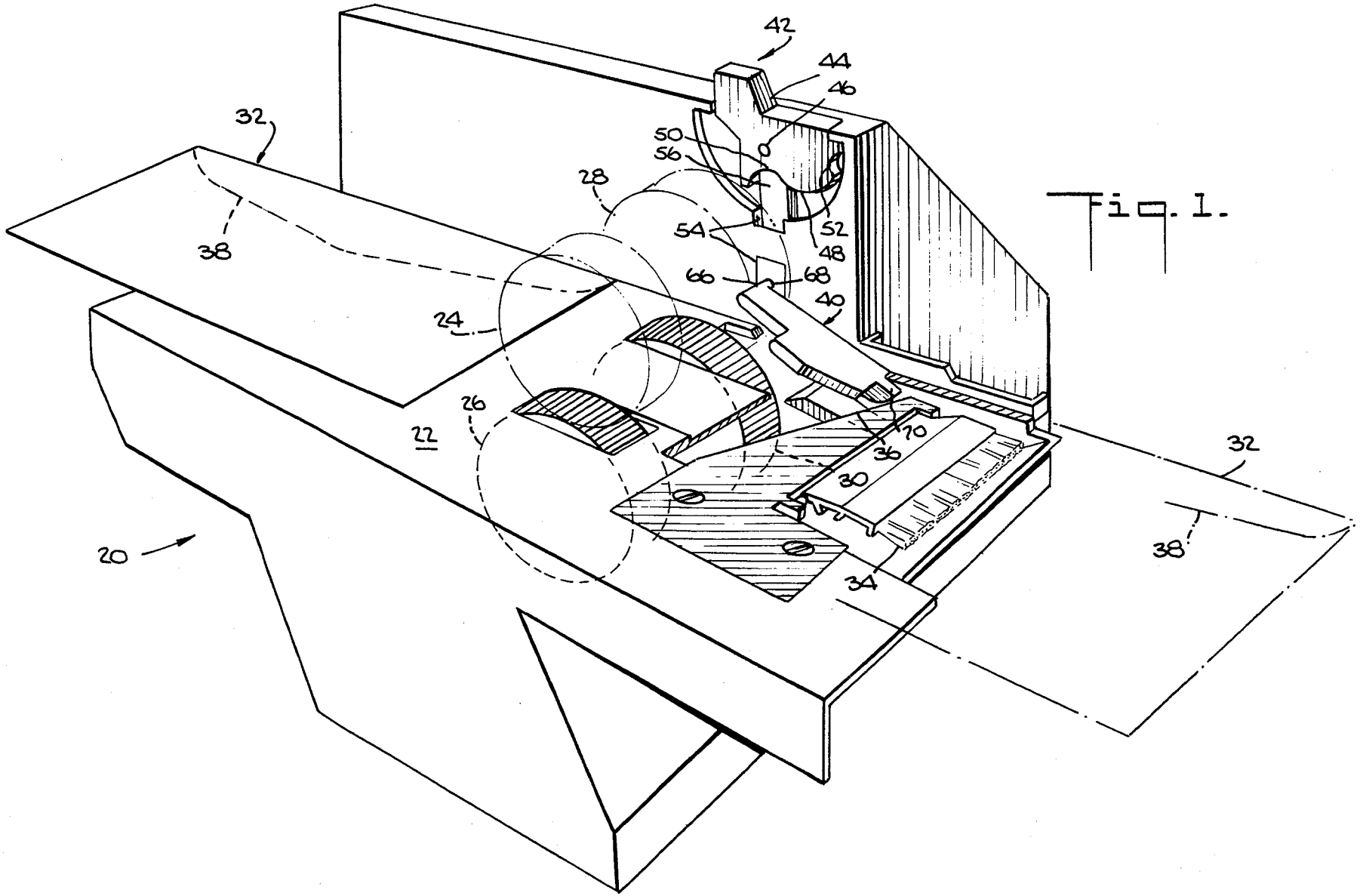
FIG. 1 is a perspective view of a mailing machine embodying an envelope flap sealing device in accordance with the instant invention.
Figures 2, 3, 5:
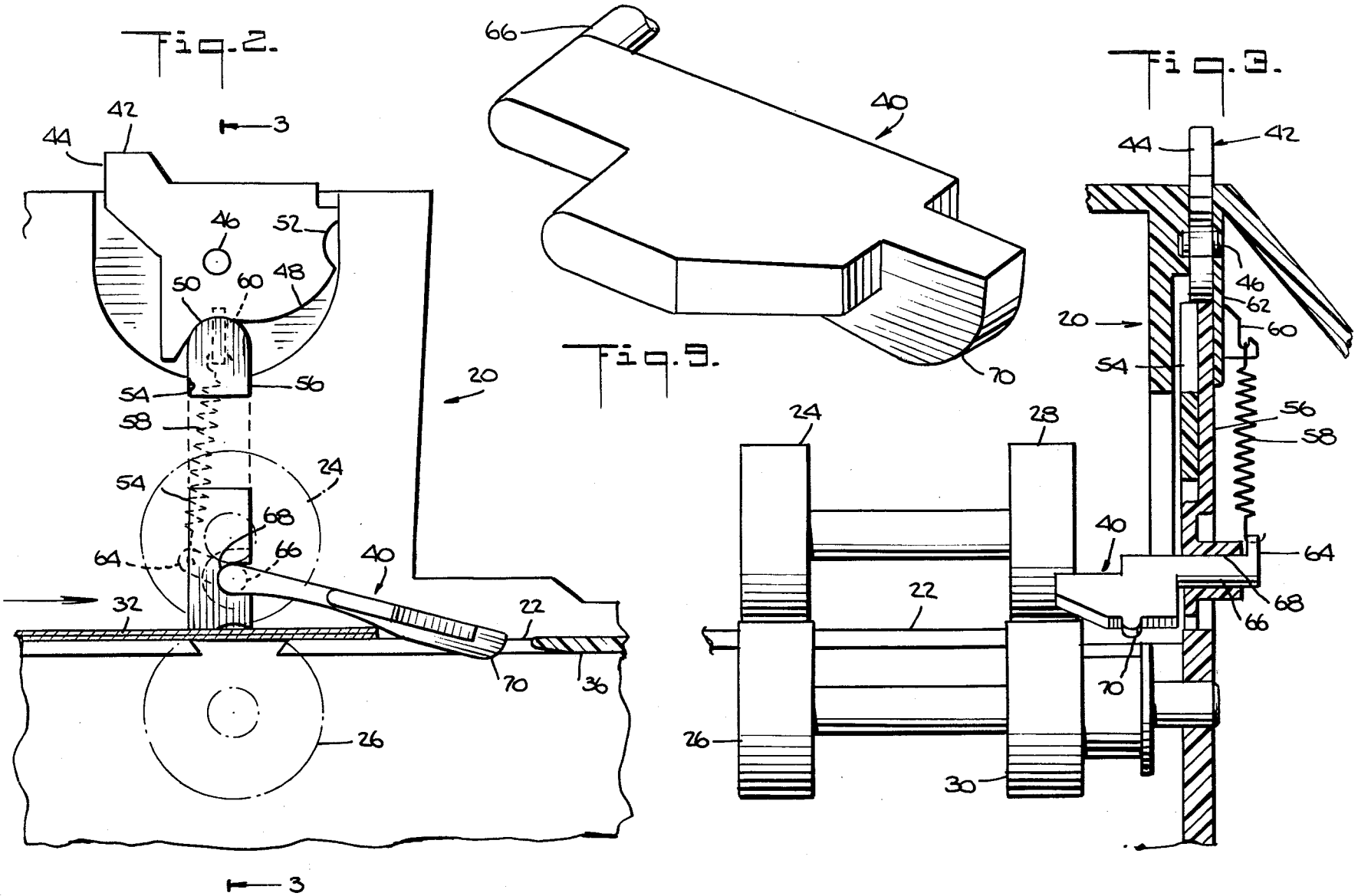
FIG. 2 is a side elevational view of the envelope flap sealing device seen in FIG. 1 showing the deflector blade in the moistening position.
FIG. 3 is a sectional view taken on the vertical plane indicated by the line 3—3 of FIG. 2.
FIG. 5 is a side elevational view of the envelope flap sealing device with the deflector blade in the moistening position and an envelope passing under the deflector blade and over the moistener separator blade and moistening brush.
Figures 4, 5:
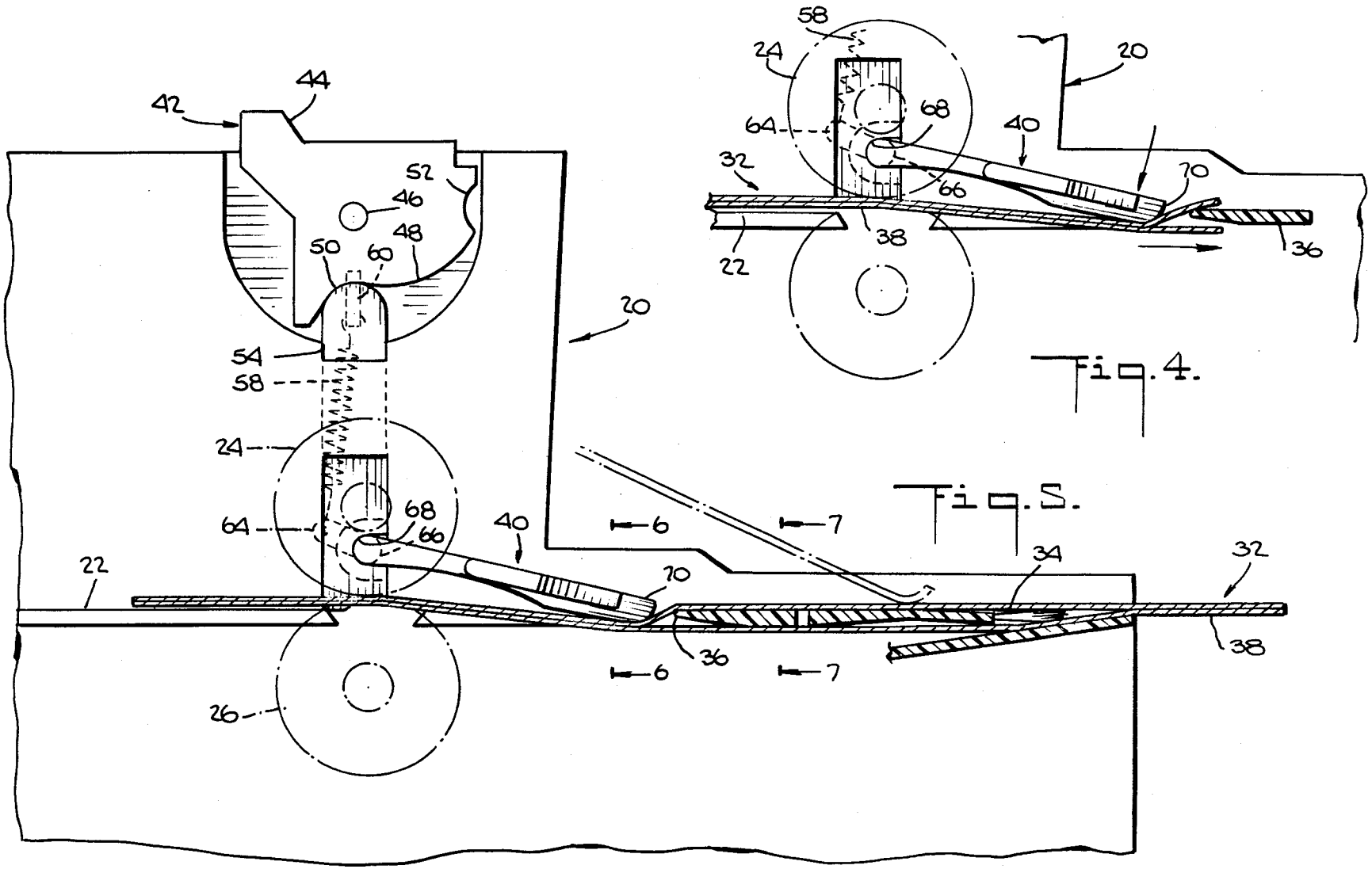
FIG. 4 is a side elevational view of the deflector blade in the moistening position and an envelope approaching the moistener separator blade.

In describing the preferred embodiment of the instant invention, reference is made to the drawings wherein there is seen an envelope sealing device generally designated 20 which is typically located in front of and attached to a mailing machine (not shown) having a postage meter secured thereto for printing postage indicia on the envelope. The sealing device 20 includes a feeding platform 22 and a first pair of feed rollers 24 and 26 and a second pair of feed rollers 28 and 30 for driving each envelope 32 toward the moistening brush 34.

The sealing device 20 includes a moistener separator blade 36 to which the brush 24 is pivotably secured for separating the flap 38 of the envelope 32 and guiding the flap 38 under the moistening brush 34 when it ts desired to moisten and seal the envelope 32. When it is not desired to moisten and seal the envelope 32, the flap 38 is guided over the moistener separator blade 36 in a manner to be described more fully hereinafter so that the glued surface of the flap 38 cannot come into contact with the moistening brush 34.

Figures 6, 7, 8:
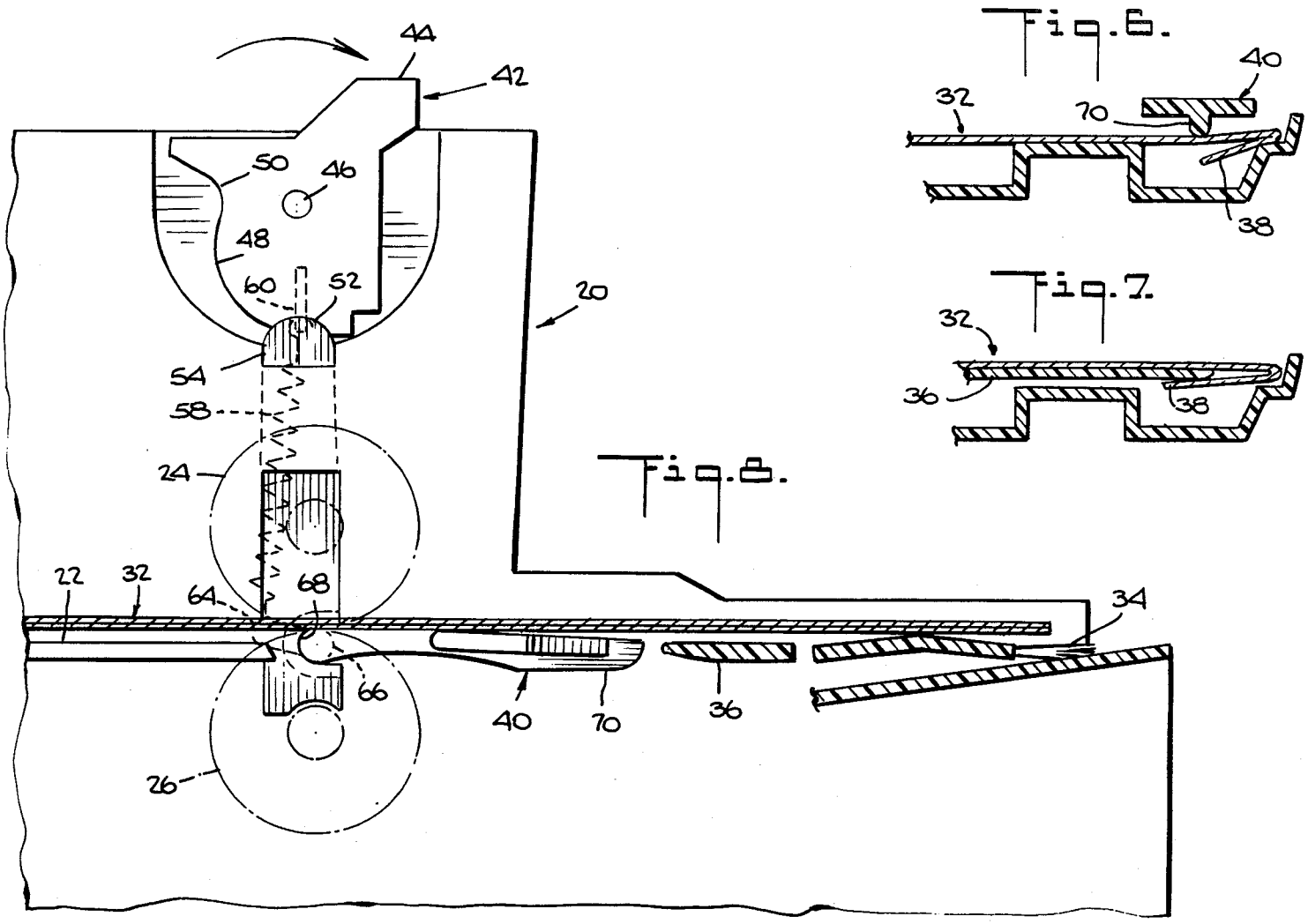
FIG. 6 is a sectional view taken on the vertical plane indicated by the line 6—6 of FIG. 5.
FIG. 7 is a sectional view taken on the vertical plane indicated by the line 7—7 in FIG. 5.
FIG. 8 is similar to FIG. 5 but it shows the deflector blade in the dry position and an envelope passing over the deflector blade, moistener separator blade and moistening brush.

Whether or not an envelope flap 38 goes under the moistening brush 34 in order to be moistened or goes over the brush 34 in order not to be moistened is determined by the positioning of a deflecting baffle 40 pivotable between a raised position (see FIGS. 1, 2, 4 and 5) and a flat position (see FIG. 8). The sealing device 20 includes a selector knob 42 having a handle 44. The knob 42 is rotatably mounted on a shaft 46 and includes a camming surface 48 having a first detent 50 and a second detent 52. The sealing device 20 also includes a slot 54 for guiding a cam follower member 56 which rides therein and is biased upwardly against the camming surface 48 by means of a coil spring 58 secured at its top end to a hook 60 projecting from a frame portion 62 of the sealing device 20 and at its bottom end to an arm 64 which projects perpendicular from a shaft 66 which is a part of the baffle 40. The shaft 66 is rotatably mounted in an aperture 68 situated at the bottom of the cam follower member 56.

The deflecting baffle 40 includes a pressure lobe 68 which provides a camming surface for opening the envelope flap 38 as it moves toward the moistening brush 34 to thereby cause the flap 38 to pass under the separator blade 36 and consequently under the moistening brush 34.

In operation, when it is desired to have an envelope 32 pass over the moistening brush 34, the operator merely grasps the handle 44 of the selector knob 42 and rotates the knob 42 clockwise to the position seen in FIG. 8, thereby causing the second detent 52 to urge the follower member 56 downward against the bias of the spring 58, which in turn causes the shaft 66 of the baffle 40 to be lowered and rotated in the aperture 68 so that the baffle 40 lies in a horizontal plane. Since the shaft 66 lies at the upstream end of the baffle 40, the effect of rotating the knob 42 clockwise is to pivot the baffle 40 about its downstream end. An envelope 32 being fed toward the moistening brush 34 will be caused to have its flap 38 pass over the separator blade 36 and brush 34 so that no wetting and sealing can take place.

When it is desired to seal an envelope 32, the operator grasps the handle 44 of the knob 42 and rotates the knob 42 counterclockwise to the position seen in FIGS. 1, 2, 4 and 5, thereby allowing the follower member 56 to rise and be biased upwardly by the spring 58 against the first detent 50 of the camming surface 48. The upward movement of the follower member 56 causes the shaft 66 of the baffle 40 to rotate in the aperture 68 and move upwardly, thereby causing the upstream end of the baffle 40 to be raised. An envelope 32 being fed toward the moistening brush 34 will be caused to have its flap 38 pass under the separator blade 36 by the camming action of the pressure lobe 70 against the envelope 32, resulting in the flap 38 passing under the moistening brush 34 and thereby being moistened and ultimately sealed.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In a mailing machine, an envelope flap sealing device, comprising:

a moistener separator blade;

a moistening brush attached to and located downstream of said separator blade;

at least one pair of feed rollers for transporting envelopes past said moistening brush;

a pivotable, deflecting baffle situated intermediate said feed rollers and said separator blade; and a selector knob having a camming surface, said knob being operatively connected to said deflecting baffle for pivoting said baffle about its downstream end whereby the upstream end of said baffle is translatable between a raised position and a flat position, wherein the raised position guides an envelope flap under said moistening brush to thereby seal said flap and the flat position causes said envelope flap to pass over said moistening brush and not be sealed.

2. The combination of claim 1, additionally comprising a feeding platform adjacent and upstream of said feed rollers.

3. The combination of claim 2, wherein the deflecting baffle includes a pressure lobe for opening the envelope flap.

4. The combination of claim 3, wherein said deflecting baffle additionally includes a shaft extending therefrom and an arm projecting perpendicular from the shaft and operatively connected to said knob.

5. The combination of claim 4, additionally comprising a cam follower biased upwardly against said camming surface and secured at its bottom end to the projecting arm of the deflecting baffle.

6. The combination of claim 5, wherein said camming surface includes a pair of detents for receiving the top end of said cam follower, one detent being for the raised position of the deflecting baffle and the second detent being for the flat position of the deflecting baffle.

* * * * *